US006360399B1

(12) United States Patent
Vandenbelt et al.

(10) Patent No.: US 6,360,399 B1
(45) Date of Patent: Mar. 26, 2002

(54) HAND-HELD VACUUM CLEANER WITH INTERCHANGEABLE CONTROL PANEL MODULE

(75) Inventors: Rudy A. Vandenbelt; Bjarki Hallgrimsson, both of Ottawa (CA)

(73) Assignee: Hezdwzlers Research & Development, Inc., Ottawa (CA)

( * ) Notice: Subject to any disclaimer, the term of this patent is extended or adjusted under 35 U.S.C. 154(b) by 0 days.

(21) Appl. No.: 09/805,875

(22) Filed: Mar. 14, 2001

(51) Int. Cl.[7] ..... A47L 5/24; A47L 9/28; A47L 9/30

(52) U.S. Cl. ..... 15/324; 15/339; 15/344; 15/DIG. 1

(58) Field of Search ..... 15/339, 344, 324

(56) References Cited

U.S. PATENT DOCUMENTS 4,654,924 A * 4/1987 Getz et al. ..... 15/339 X
4,656,687 A * 4/1987 Wei ..... 15/324
4,773,120 A * 9/1988 Wang ..... 15/344
4,789,310 A * 12/1988 Hung ..... 15/344 X
4,791,700 A * 12/1988 Bigley et al. ..... 15/324
4,817,234 A * 4/1989 Greulich ..... 15/339
5,664,282 A * 9/1997 Castwell et al. ..... 15/339 X

* cited by examiner

*Primary Examiner*—Chris K. Moore
(74) *Attorney, Agent, or Firm*—Albert Peter Durigon

(57) ABSTRACT

An interchangeable control panel module removably mountable to the housing of the powered unit of a hand-held vacuum cleaner may be configured to provide the feature mix of a given product model without requiring redesign of the housing of the powered unit to accommodate the feature mixes of different product models. The feature face of the interchangeable control panel module is aesthetically continuous with the housing of the powered unit and may be configured to include at least one of an on/off power switch, a headlight and a battery charge indicating bar graph.

5 Claims, 3 Drawing Sheets

HAND-HELD VACUUM CLEANER WITH INTERCHANGEABLE CONTROL PANEL MODULE

CROSS-REFERENCE TO RELATED APPLICATIONS

This application is related to U.S. patent application Ser. No. 09/553139, entitled Dual Filter Wet/Dry Hand-Held Vacuum Cleaner, filed Apr. 19, 2000, incorporated herein by reference, and to United States utility patent application entitled De-Turbulent Hand-Held Vacuum Cleaner filed on even date herewith, incorporated herein by reference.

FIELD OF THE INVENTION

This invention is drawn to the field of vacuum cleaners, and more particularly, to a novel hand-held vacuum cleaner with interchangeable control panel module.

BACKGROUND OF THE INVENTION

Hand-held vacuum cleaners may be variously configured from "base" to "deluxe" models to provide a range of different features. For example, a minimum feature configuration to provide a base model hand-held vacuum cleaner may include a dust bowl, and a powered unit having a molded plastic housing to which a power "on" and "off" switch is mounted. With controlled application of power via the on/off power switch, solid and/or liquid foreign matter may be removed by such a base model hand-held vacuum cleaner.

When it is desirable to incorporate other features beyond those of such a base, or minimum feature configuration, model into a hand-held vacuum cleaner, it is the usual practice to design another hand-held vacuum cleaner model that includes the specific feature mix desired. Typically, this requires a redesign of the thermoplastic housing of the powered unit, with concomitant, often considerable, molding, tooling and other expenses associated with each model's specifically different feature mix.

There is thus a need to provide a hand-held vacuum cleaner that can accommodate the feature mix of a wide line of product models, without requiring powered unit housing redesign to provide the feature mix of each given product model.

SUMMARY OF THE INVENTION

Accordingly, it is an object of the present invention to disclose a hand-held vacuum cleaner with interchangeable control panel module that may be configured to provide the feature mix of a given product model without requiring redesign of the housing of the powered unit to accommodate the feature mixes of different product models.

In accordance therewith, the disclosed hand-held vacuum cleaner with interchangeable control panel module of the present invention includes a dust bowl removably attached to a powered unit. The powered unit includes a housing adapted to receive an interchangeable control panel module, and an interchangeable control panel module is received in said housing.

The interchangeable control panel module received in the housing of the powered unit in the presently preferred embodiment includes an exposed feature face aesthetically continuous with the housing of the powered unit that has at least one feature selected from the group of features including a power switch, a headlight and a bar graph charge indicator, and further includes a printed circuit board operatively coupled to the exposed feature face that is adapted for receipt within the housing of the powered unit. By configuring the interchangeable control panel module with a selected feature mix, and mounting the printed circuit board thereof into the housing of the same powered unit, the hand-held vacuum cleaners of the present invention provide the feature mix of a given product model without requiring redesign of the housing of the powered unit to accommodate the feature mixes of different product models.

BRIEF DESCRIPTION OF THE DRAWINGS

These and other objects, inventive aspects and advantageous features of the present invention will become apparent as the invention becomes better understood by referring to the following slowly exemplary detailed description of the presently preferred embodiments thereof, and to the drawings, wherein.

DETAILED DESCRIPTION OF THE PRESENTLY PREFERRED EMBODIMENTS

Figure 1:
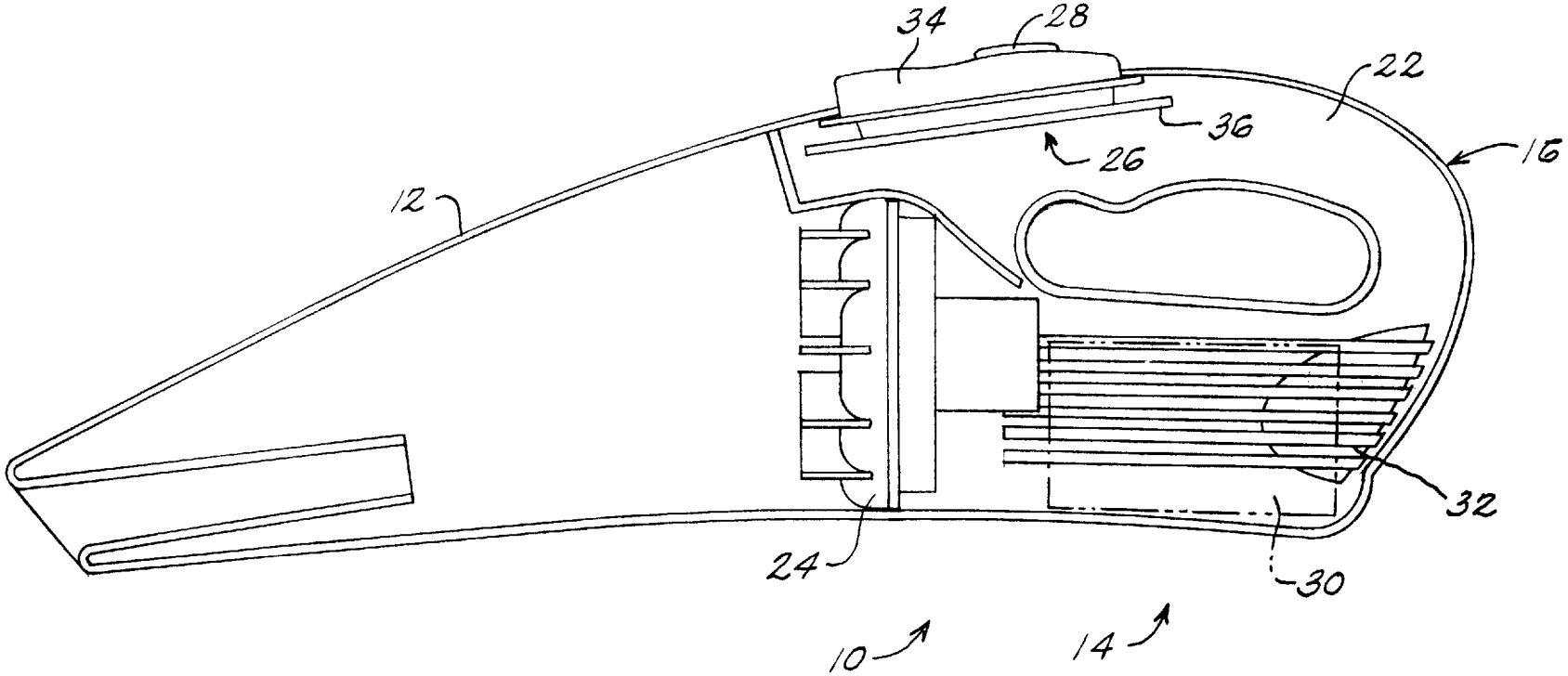
FIG. 1 is a longitudinal sectional view of a hand-held vacuum cleaner with interchangeable control panel module in accord with the present invention.

Referring now to FIG. 1, generally designated at 10 is a longitudinal sectional view of one presently preferred embodiment of a hand-held vacuum cleaner with interchangeable control panel module in accord with the present invention. The hand-held vacuum cleaner with interchangeable control panel module 10 includes a dust bowl 12 that is removably attached to a powered unit generally designated 14. The dust bowl 12 may be provided with a liquid separator to allow for wet/dry operation, not shown. One or more filters, not shown, may be provided intermediate the dust bowl and powered unit to separate particulates received through the inlet nozzle of the dust bowl. The principles of the present invention apply to any and all hand-held vacuum cleaners which may be wet and/or dry and have one or more filters.

The powered unit 14 includes a housing generally designated 16 that provides a handle 22. A vacuum impeller assembly 24 is mounted in the housing 16 of the powered unit 14 to provide suction at the forward end of the powered unit 14.

An interchangeable control panel module generally designated 26 to be described including a power switch 28 is removably mounted to the housing 16 of the powered unit 14 along its top, with the power switch 28 in position to be manually actuated when the handle 22 is grasped.

A battery 30 shown in dashed outline is mounted in the housing 16 that is operatively connected to the vacuum impeller assembly 24 and control panel module 26. An exhaust vent 32 is provided at the rear of the housing 16 of the powered unit 14 in fluid communication with the vacuum impeller assembly 24. In the illustrated embodiment, the housing 16 and battery 30 are so dimensioned as to provide fluid communication between the vacuum impeller assembly 24 and exhaust vent 32, although any other means suitable to provide fluid communication therebetween could be employed. Although a rear exhaust vent is illustrated in the presently preferred embodiment, any exhaust vent and exhaust location may be employed.

Figure 2:
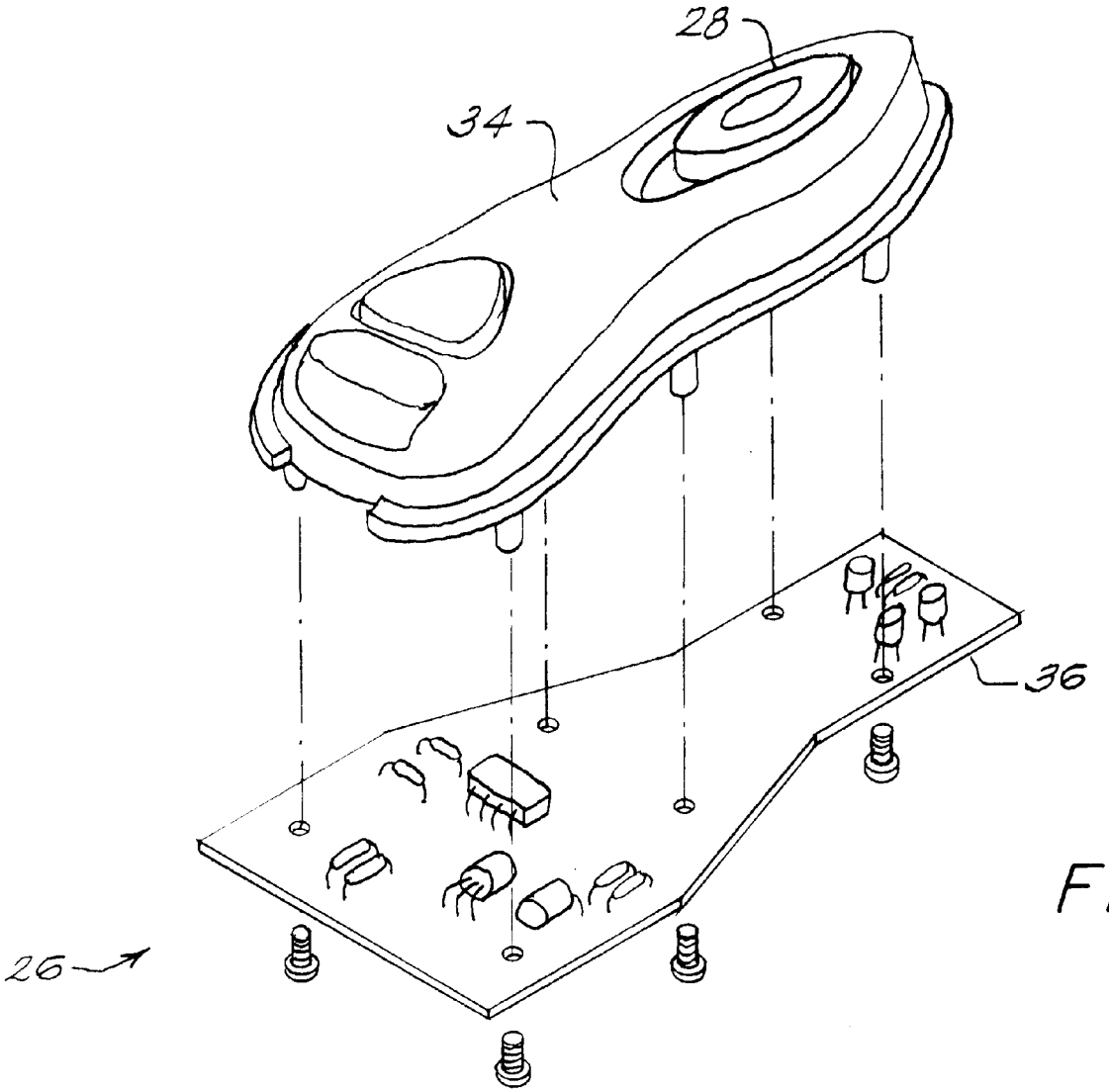
FIG. 2 is an exploded perspective view of the interchangeable control panel module of the hand-held vacuum cleaner with interchangeable control panel module in accord with the present invention.

Referring now to FIGS. 1 and 2, the interchangeable control panel module 26 includes an exposed feature face 34, aesthetically continuous with the housing 16, and a printed circuit board 36 operatively connected therewith. The interchangeable control panel module 26 is adapted to be received within the housing 16 of the powered unit 14 and may be specifically configured as appears more fully below to conform to the particular feature mix of a given product model. In the presently preferred embodiment, the housing 16 includes a recess, not shown, adapted to receive the printed circuit board 36 of the interchangeable control panel module 26 and capture the same therewithin, although other means to removably mount the interchangeable control panel module 26 to the housing 16 of the powered unit 14 may be employed without departing from the inventive concepts.

Figure 3C:
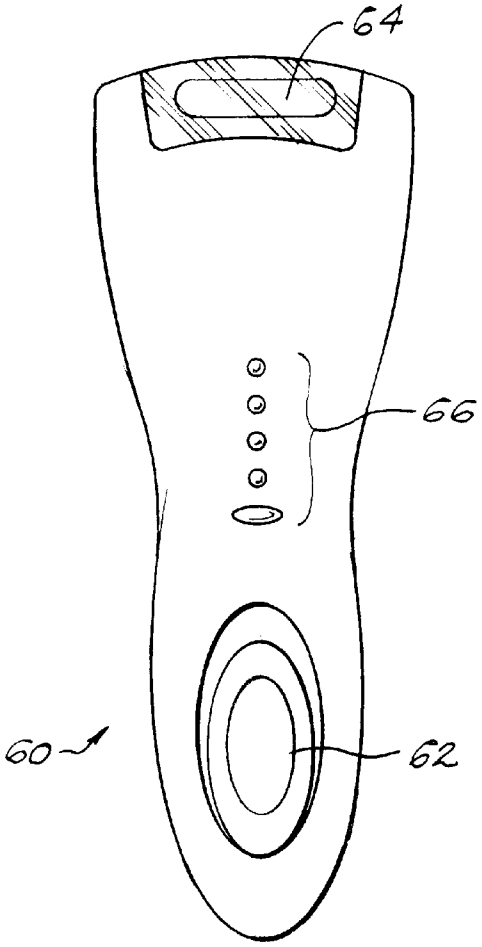
FIG. 3 in the FIGS. 3A, 3B, and 3C thereof illustrates top plan views of the interchangeable control panel module configured with different feature mixes of the hand-held vacuum cleaner with interchangeable control panel module in accord with the present invention.
Figure 3B:
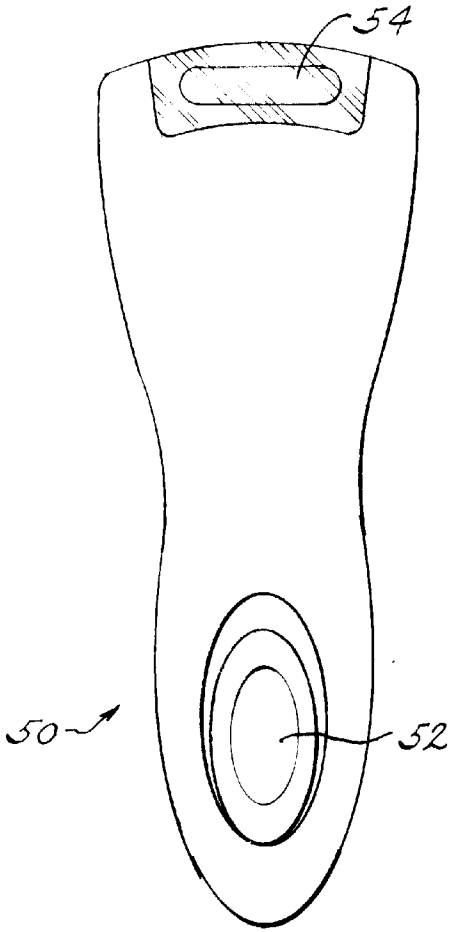
Figure 3A:
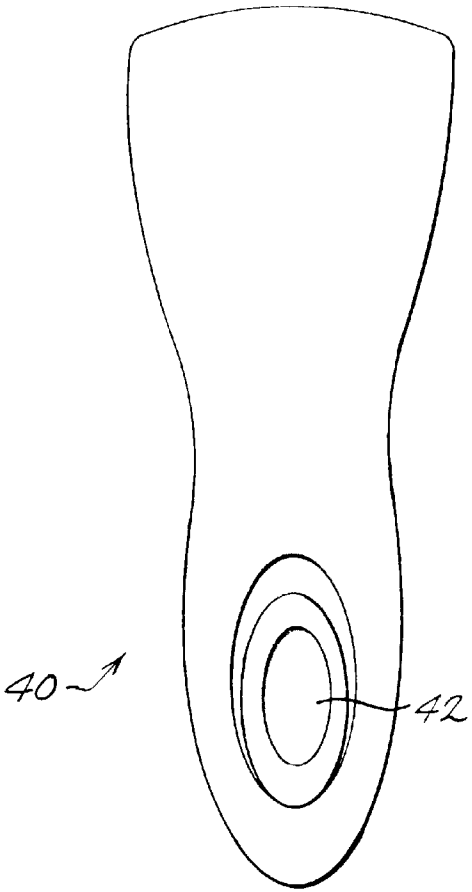

Referring now to FIG. 3, generally designated at 40, 50, and 60 respectively in the FIGS. 3A, 3B, and 3C thereof are top plan views of interchangeable control panel modules configured with specifically different feature mixes.

The control panel module 40 of FIG. 3A is configured with an "on" and "off" power switch 42. The control panel module 50 of FIG. 3B is configured with an "on" and "off" power switch 52 and a headlight 54. The control panel module 60 of FIG. 3C is configured with an "on" and "off" power switch 62, headlight 64 and bar graph indicating battery power level designated by bracket marked 66.

It will be appreciated the power switch, headlight and battery power indicating bar graph features are presently preferred, but any other features are contemplated, such as one or more indicator lights to indicate charge level of the battery; one or more indicator lights, dials, or other means to indicate time to clean-out of the unit; and one or more indicator lights, dials, or other means to indicate the quality of the exhausted air.

Many modifications of the presently disclosed invention will become apparent to those of skill in the art without departing from the scope of the appended claims.

What is claimed is:

1. A hand-held vacuum cleaner with interchangeable control panel module that may be configured to provide the feature mix of a given product model without requiring redesign of the housing of the powered unit to accommodate the feature mixes of different product models, comprising:

a powered unit;

a dust bowl removably attached to said powered unit;

said powered unit including a housing adapted to removably mount an interchangeable control panel module; and an interchangeable control panel module adapted to be removably mounted in said housing;

said interchangeable control panel module having an exposed feature face aesthetically continuous with the housing;

said exposed feature face aesthetically continuous with the housing of said powered unit of said interchangeable control panel module adapted to be removably mounted in said housing of said powered unit including at least one feature selected from the group of features consisting of a power switch, a headlight and a bar graph battery charge indicator.

2. The hand-held vacuum cleaner with interchangeable control panel module that may be configured to provide the feature mix of a given product model without requiring redesign of the housing of the powered unit to accommodate the feature mixes of different product models of claim 1, wherein said interchangeable control panel module includes a printed circuit board mechanically joined to said exposed feature face thereof and operatively connected to said at least one selected feature of said interchangeable control panel module.

3. The hand-held vacuum cleaner with interchangeable control panel module that may be configured to provide the feature mix of a given product model without requiring redesign of the housing of the powered unit to accommodate the feature mixes of different product models of claim 2, wherein said printed circuit board is adapted to be received in said housing of said powered unit.

4. A hand-held vacuum cleaner with control panel, comprising:

a powered unit;

a dust bowl removably attached to said powered unit;

said powered unit includes a housing adapted to mount a control panel; and a control panel adapted to be mounted to said housing having an exposed feature face aesthetically continuous with the housing including a headlight.

5. A hand-held vacuum cleaner with control panel, comprising:

a powered unit;

a dust bowl removably attached to said powered unit;

said powered unit includes a housing adapted to mount a control panel; and a control panel adapted to be mounted to said housing having an exposed feature face aesthetically continuous with the housing including a bar graph battery charge indicator.

* * * * *